United States Patent [19]

Brandt

[11] 4,127,156

[45] Nov. 28, 1978

[54] BURGLAR-PROOF SCREENING

[76] Inventor: James R. Brandt, 1050 N. Loudon Twp. Rd. 47, Fostoria, Ohio 44830

[21] Appl. No.: 866,751

[22] Filed: Jan. 3, 1978

[51] Int. Cl.[2] ..... E06B 3/80

[52] U.S. Cl. ..... 160/179; 160/369; 160/371

[58] Field of Search ..... 160/104, 179, 353, 369, 160/371, 380; 52/626, 694; 29/160

[56] References Cited

U.S. PATENT DOCUMENTS

| | | | |
|---|---|---|---|
| 253,732 | 2/1882 | MacDonald | 160/179 |
| 836,884 | 11/1906 | Loscher | 52/626 |
| 1,351,940 | 9/1920 | Blake | 160/380 |
| 1,540,788 | 6/1925 | McClure | 52/626 |
| 2,735,522 | 2/1956 | Lee | 52/626 |
| 2,744,346 | 5/1956 | Auerbach-Levy | 160/369 |
| 3,414,237 | 12/1968 | Bishoff, Sr., et al. | 52/626 |
| 3, 871,434 | 3/1975 | Hance | 160/179 |

*Primary Examiner*—Peter M. Caun

*Attorney, Agent, or Firm*—Clarence A. O'Brien; Harvey B. Jacobson

[57] ABSTRACT

Burglar-proof screening for use with conventional screen doors, and the like, includes a framework provided with an opening and removably clampable into the conventional cutout provided in a screen door for removably receiving screening. A screen is removably arrangeable on the framework covering the opening provided therein, together with a grille arrangeable disposed substantially coextensive with, but spaced from the screen. The grille is removably mounted on the framework by connectors constructed in such a manner as to make it virtually impossible to remove the grille from outside of the structure associated with the door or other closure.

5 Claims, 8 Drawing Figures

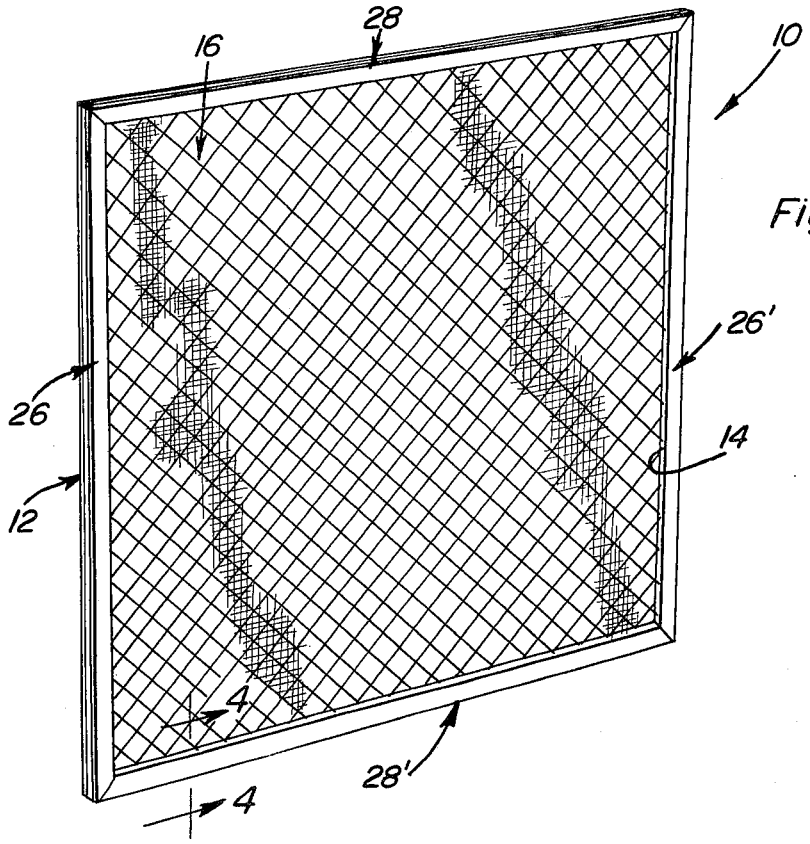
Fig. 1
Fig. 2
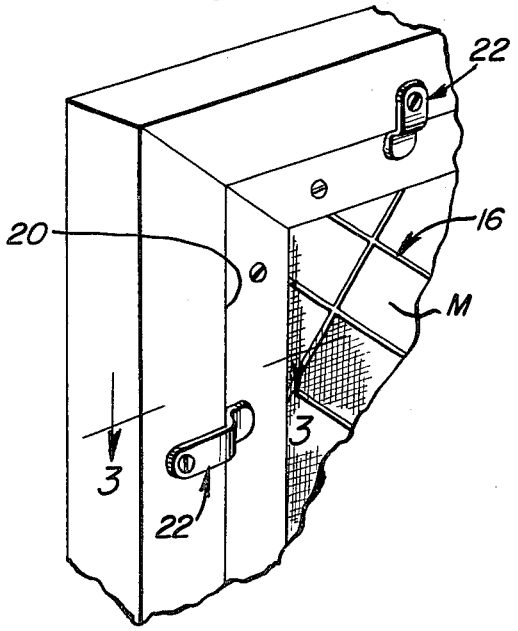
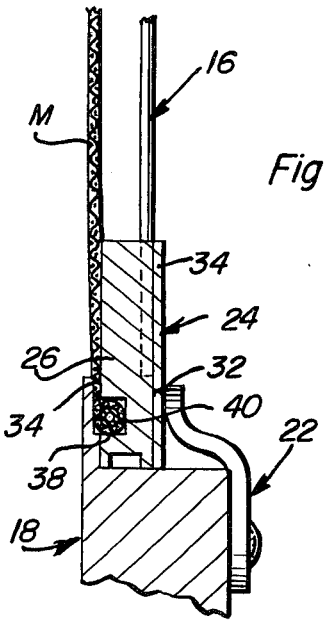
Fig. 3

Fig. 7
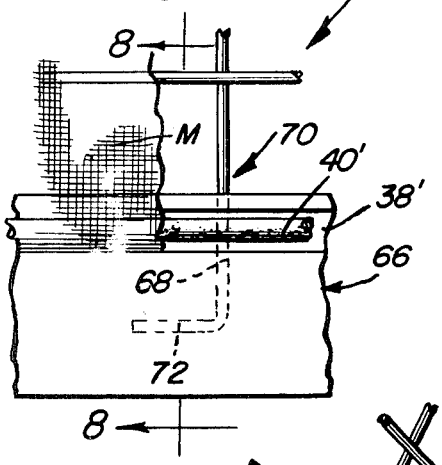
Fig. 8
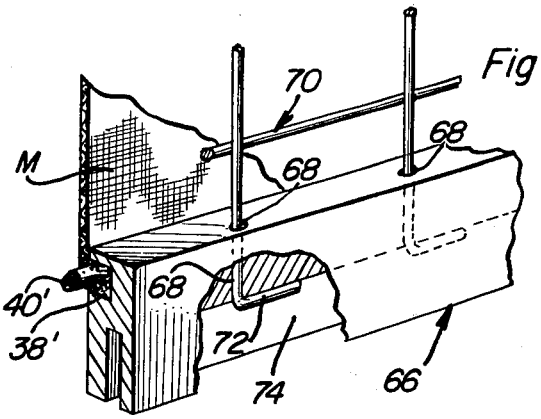
Fig. 4
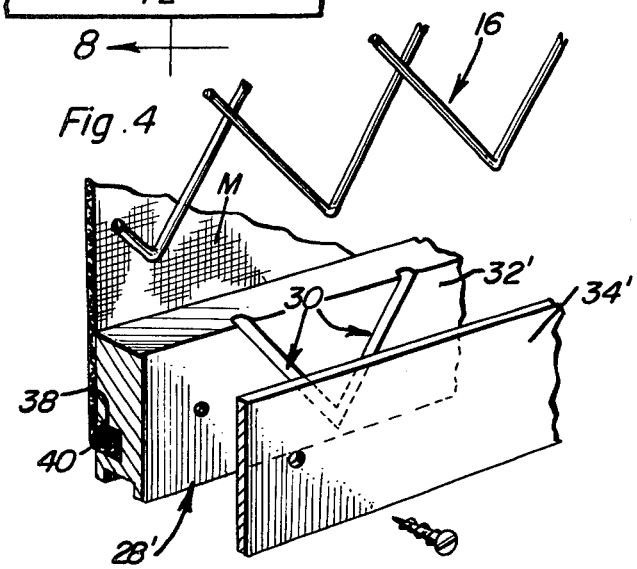
Fig. 6
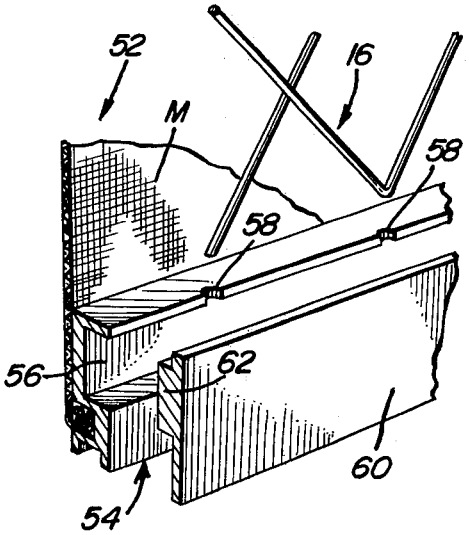
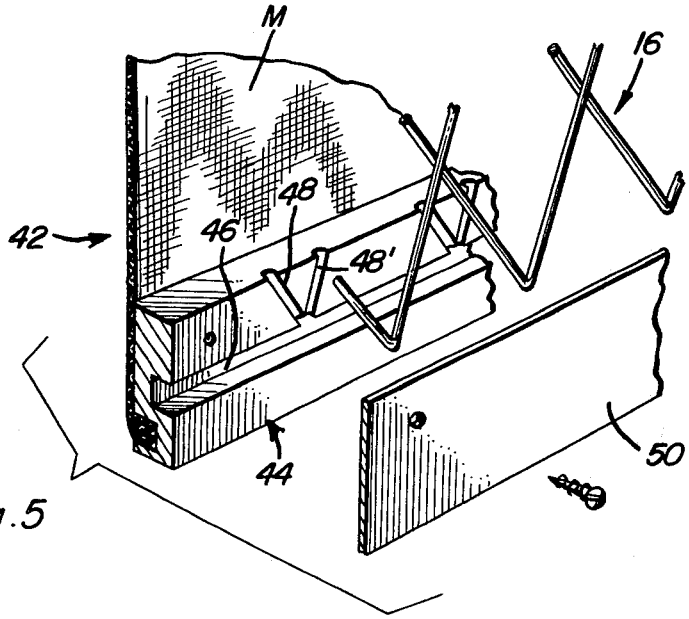
Fig. 5

BURGLAR-PROOF SCREENING

BACKGROUND OF THE INVENTION

1. Field of the Invention

This invention relates generally to screening for doors and other closures, and particularly to a system permitting screening to be combined with grille work discouraging unauthorized intrusion into a space associated with the closure.

2. Description of the Prior Art

It is generally desirable, and in the best interest of energy conservation, to open doors and windows of a house or other structure during warm weather in order to attempt to maintain the interior of the structure at a comfortable temperature for persons therewithin without the use of refrigeration or other cooling systems. A difficulty arises, especially during the nighttime, with leaving such closures open, inasmuch as unauthorized entry into the structure is greatly facilitated. Although screens are commonly employed over openings provided in doors, windows, and the like, in order to prevent flies and other insects from entering the structure, such screens are no deterrent to the unauthorized entry of burglars. Accordingly, it is desirable to provide a suitable grille in conjunction with such screens in order to prevent the unauthorized entry of persons into the building associated with the screens.

Examples of door and window screens having grilles associated therewith can be found in U.S. Pat. Nos. 332,655, issued Dec. 15, 1885, to R. Hammill; 600,904, issued Mar. 22, 1898, to T. H. C. Beall; 1,476,565, issued Dec. 4, 1923, to L. A. Yeager; and 1,991,532, issued Feb. 19, 1935, to G. P. Wicker. In addition, U.S. Pat. No. 566,846, issued Sept. 1, 1896, to R. A. Dennison, discloses a spark guard, which although intended for use in conjunction with fireplaces, and the like, employs a combined screen and grille construction similar to those of the screen door and window constructions set forth in the prior patents cited above.

SUMMARY OF THE INVENTION

It is an object of the present invention to provide a burglar-proof screen arrangement capable of use with all aluminum and steel storm doors, sliding screen doors, and the like, currently manufactured for use with removable screens.

It is another object of the present invention to provide a burglar-proof screen assembly capable of being mounted on a conventional screen door or window by use of the commonly employed clips or pins, including those using spring tension to provide the clamping action.

It is yet another object of the present invention to provide burglar-proof screening in which the screen and grille thereof are mounted on an associated framework in a simple, yet rugged and reliable manner, which makes it virtually impossible for the grille to be removed from the frame from outside of a structure associated with the screening, and without removing the screening from the associated closure itself.

These and other objects are achieved according to the present invention by providing burglar-proof screening having: a framework provided with an opening; a screen arranged covering the opening which is provided in the framework; a holding arrangement provided on the framework for attaching the screen to the framework; a grille arranged covering the opening provided in the framework, with the grille being disposed substantially coextensive with, but spaced from the screen; and a connector assembly provided on the framework for attaching the grille to the framework.

According to a preferred construction of the invention, the framework includes a rail having a pair of substantially parallel faces, with the connector assembly including a recess provided in one of the faces of the rail and arranged for receiving a portion of the grille, with a cover being removably attached to the rail in clamping relation with respect to the face in which the recess is provided for retaining the portion of the grille within the recess.

According to one preferred embodiment of the invention, the recess provided in the rail is substantially V-shaped, with the grille having a diamond pattern and forming a V-shaped element at a peripheral portion thereof, which V-shaped element is matingly received in the V-shaped recess provided in the rail. As will be readily appreciated, a plurality of V-shaped recesses are provided in the rail for receiving adjacent V-shaped elements forming the periphery of the grille, with two pairs of similar parallel rails being arranged perpendicular with one another to form the framework in a rectangular configuration.

According to another preferred embodiment of the invention, the rail is provided in the one of the faces thereof with a trough, and the legs of the V-shaped recess terminate in the trough in the direction which the legs converge toward one another, so that the juncture of the legs is truncated by the trough.

Yet another preferred embodiment of the invention provides a projection on the cover, which projection is fittingly received within the trough by a force fit for retaining the cover on the rail without the necessity of using screw fasteners, and the like. In this construction, the recesses may be of such a short length as to receive only the juncture of each of the V-shaped elements of the grille, and not be divided into a pair of legs or other portions.

A preferred embodiment of the invention particularly suited for use with grilles of rectangular as opposed to diamond, or diagonally-crossed element, construction, provides a plurality of apertures in a rail communicating with the recess, which in this instance is disposed along a bottom edge of the rail. The longitudinally extending elements forming the periphery of such a rectangular-grid grille can be inserted in the apertures and then bent over within the trough substantially 90° of the extent of the associated apertures for retaining the grille on the rail.

The screen may be held on the framework in a conventional manner by providing a groove in the other of the faces of the rail, with a gasket being removably arrangeable in the groove with a tight fit for retaining a peripheral edge of the screen in the groove. While the screen may be on the outer surface of the screening arrangement as same is disposed in the closure, the cover of the connector assembly should be disposed on the inner surface and preferably engaged by the clamps holding the screening within the closure in order to prevent unauthorized removal of the grille from the closure.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a schematic, perspective view showing burglar-proof screening according to the present invention.

FIG. 2 is an enlargwed, fragmentary, perspective view showing the upper left hand corner of the screen seen in FIG. 1.

FIG. 3 is an enlarged, fragmentary, sectional view taken generally along the line 3—3 of FIG. 2.

FIG. 4 is an enlarged, fragmentary, sectional, exploded perspective view taken generally along the line 4—4 of FIG. 1.

FIG. 5 is a fragmentary, sectional, exploded perspective view, similar to FIG. 4, but showing a second embodiment of the present invention.

FIG. 6 is a fragmentary, sectional, exploded perspective view, similar to FIGS. 4 and 5, but showing yet another embodiment of the present invention.

FIG. 7 is a fragmentary, front elevational view showing a still further embodiment of the present invention.

FIG. 8 is a fragmentary, sectional, perspective view taken generally along the line 8—8 of FIG. 7.

DESCRIPTION OF THE PREFERRED EMBODIMENTS

Referring now more particularly to FIGS. 1 through 4 of the drawings, an embodiment of the invention is disclosed wherein a screen 10 includes a framework 12 provided with an opening 14. A grille 16 is arranged covering opening 14, and is disposed substantially coextensive with, but spaced from, a parallel sheet of screen mesh M also mounted on framework 12. Screen 10 itself is removably mounted in a closure, such as a door 18, having provided therein a cutout 20 and being furnished with clamps 22 of a conventional nature which cooperate with framework 12 to retain screen 10 within cutout 20. More specifically, clamps 22 bias framework 12 of screen 10 against a lip formed by a ledge provided for receiving framework 12. A connector system 24 is provided on framework 12 for attaching grille 16 to the framework 12.

Framework 12 includes two pairs of substantially parallel rails 26, 26' and 28, 28' arranged generally perpendicular to one another to form a generally rectangular open frame. Each of these rails 26, 26' and 28, 28' is provided with a plurality of V-shaped recesses 30 on a face 32 thereof, which recesses 30 are arranged for receiving a portion of grille 16. More specifically, the generally diamond shape of the grid of grille 16 forms V-shaped elements along the periphery of the grille, which V-shaped elements are of a size and spacing corresponding to that of the recesses 30 so as to be received within the recesses 30. A cover 34 in the form of a flat plate is removably attached to the associated rails 26, 26' and 28, 28' in a suitable manner, such as by the illustrated screw fasteners for retaining the portions of grille 16 within recesses 30. As will be appreciated, the cover 34 will be disposed under clamps 22 when framework 12 is mounted in a cutout 20 of a door 18 or other suitable closure.

The mesh M is retained on framework 12 by use of a holding arrangement provided on a face 36 of rail 26, 26' and 28, 28', which face 36 is substantially parallel to face 32, and in which face 36 is provided a groove 38 extending the longitudinal extent of the associated rail. A suitable gasket 40, such as a length of resilient tubing, is inserted into groove 38 so as to form a tight fit therein and retain the peripheral edge of mesh M on the associated rail 26, 26' and 28, 28'. Although the groove 38 is shown in FIGS. 1 through 4 as disposed along the lower edge of an associated rail so as to be caught behind the lip of the closure in which screen 10 is mounted, it will be appreciated that such location of the groove 38 is not critical to the invention.

Referring now more particularly to FIG. 5 of the drawings, a screen 42 according to the invention is shown as including a rail 44 in which is provided a trough 46 arranged extending longitudinally of the extent of rail 44. Recesses including legs 48, 48' converging toward one another terminate in trough 46 in such a manner so that the vertex of a V-shaped recess which would normally be formed is truncated by trough 46. A cover 50 in the form of a plate and similar to cover 34, 34' of connector system 24 is secured to rail 44 in order to retain the V-shaped peripheral portions of a grille 16 within the legs 48, 48' and trough 46.

FIG. 6 shows yet another embodiment of the present invention wherein a screen 52 includes a rail 54 which is provided with a trough 56 of greater extent over the face of the rail than trough 46. Arcuate recesses 58, 58' are provided in rail 54 so as to communicate between a top edge of rail 54 and trough 56 and permit the vertexes of the V-shaped portions of a grille 16 to be engaged with rail 54, while a cover 60 is provided with a projection 62 dimensioned to be received in trough 56 with a force fit for retaining cover 60 on rail 54 without the need of screw fasteners, and the like.

As can be seen in FIGS. 7 and 8 of the drawings, a screen 64 according to the present invention can include a rail 66 provided with a plurality of apertures 68 arranged for receiving the edge portions of a grille 70 of generally rectangular grid and terminating at the edges thereof with longitudinally extending wire-like elements 72. These elements 72 are received in the apertures 68, and are subsequently bent upon themselves so as to extend at substantially right angles to the extent of apertures 68 within a recess 74 provided in the lower edge of rail 66.

As can be readily appreciated from the above description and from the drawings, the present invention provides burglar-proof screening that will fit all conventional storm doors and windows with removable screen. The protective grille can be made in diamond or square grid design from, for example, 11 to 14 gauge welded wire pressed into the frame or bent after fitting through holes in the frame as described above.

For production design variance or cost cutting, expanded metal grate or chain link material (not shown) such as is readily available on the market, can be used to form the grille, as can also braided steel rope, and the like, such as used in bicycle locks.

By the use of the heavier framework constructed in accordance with the invention, together with the generally cutproof grille, screen doors can be depended on, even in hot weather, to keep out intruders. The grille will require a very large pair of wire cutters to be cut through, and even then great effort and considerable noise would be required to obtain entry through the screening according to the invention.

The spacing of the grid of the grille would not permit an intruder to reach through and unlock a door or window. Burglarproof screening according to the invention provides great versatility, inasmuch as it can not only be used on the conventional removable closure screening and sliding glass door screens, but in conjunction with fixed window screening as well.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a closure provided with a cutout, a screen removably mounted on the closure and disposed within the cutout, the screen comprising, in combination:

(a) a planar framework provided with an opening;

(b) a mesh arranged in the plane of the framework covering the opening provided in the framework:

(c) holding means provided on the framework for attaching the mesh to the framework;

(d) a grille arranged covering the opening provided in the framework, the grille being disposed substantially parallel to and coextensive with, but spaced from the mesh; and (e) connector means provided on the framework for attaching the grille to the framework, the framework including a rail having a pair of substantially parallel faces, and the connector means including, in combination:

(1) the rail being provided with a recess in one of the faces thereof, the recess being arranged for receiving a peripheral portion of the grille; and (2) a cover removably attached to the rail in clamping relation with the one of the faces of the rail and disposed entirely in a plane substantially parallel to the plane of the framework for retaining the peripheral portion of the grille within the recess.

2. A structure as defined in claim 1, wherein the grille is attached to the rail at a plurality of points spaced along an extent of the rail, the framework comprising two pairs of rails, each rail of the pair of rails arranged substantially parallel to the other rail and perpendicular to the rails of the other of the pairs of rails and connected together in a rectangular configuration.

3. A structure as defined in claim 2, wherein the recess is substantially V-shaped, the grille having a diamond pattern and forming a V-shaped element at the periphery of the grille, the element being received in the recess.

4. A structure as defined in claim 2, wherein the rail is provided in the one of the faces thereof with a trough extending along a longitudinal extent of the rail, with the recess having a pair of legs converging toward one another and terminating in the trough.

5. A structure as defined in claim 2, wherein the rail is provided in the one of the faces thereof with a trough arranged extending along a longitudinal extent of the rail, with the recess communicating with the trough, and the cover being provided with a projection received within the trough by a force fit for retaining the cover on the rail.

* * * * *